US009121607B2

(12) United States Patent
Labbe et al.

(10) Patent No.: US 9,121,607 B2
(45) Date of Patent: Sep. 1, 2015

(54) SMART FIRING CONTROL IN A RANKINE CYCLE POWER PLANT

(75) Inventors: Donald E. Labbe, Woburn, MA (US); Alan Morrow, Cumberland, RI (US); Andrew Speziale, Mansfield, MA (US); Thomas Kinney, Franklin, MA (US)

(73) Assignee: Invensys Systems, Inc., Foxboro, MA (US)

( * ) Notice: Subject to any disclaimer, the term of this patent is extended or adjusted under 35 U.S.C. 154(b) by 964 days.

(21) Appl. No.: 13/294,175

(22) Filed: Nov. 11, 2011

(65) Prior Publication Data

US 2013/0122433 A1 May 16, 2013

(51) Int. Cl.
*F23N 5/00* (2006.01)

(52) U.S. Cl.
CPC ..... *F23N 5/00* (2013.01); *F23N 2023/04* (2013.01); *F23N 2023/48* (2013.01); *F23N 2037/02* (2013.01); *F23N 2900/05001* (2013.01); *F23N 2900/05003* (2013.01); *F23N 2900/05006* (2013.01)

(58) Field of Classification Search
CPC ... F23N 5/00; F23N 2023/00; F23N 2023/04; F23N 2023/08; F23N 2023/44; F23N 2023/48; F23N 2037/02; F23N 2900/05006
USPC ..... 236/1 A, 11, 14, 15 BR, 15 BD, 15 BG; 431/12, 75, 78
See application file for complete search history.

(56) References Cited

U.S. PATENT DOCUMENTS

| | | | | |
|---|---|---|---|---|
| 4,622,922 | A * | 11/1986 | Miyagaki et al. | 122/449 |
| 5,244,147 | A * | 9/1993 | Furukawa | 236/15 C |
| 2007/0142975 | A1 * | 6/2007 | Piche | 700/286 |

* cited by examiner

*Primary Examiner* — Jonathan Bradford
(74) *Attorney, Agent, or Firm* — Thomas J. Roth, Esq.

(57) ABSTRACT

A multivariable control system for controlling boiler burners. The system includes burner actuators, boiler sensors, a control system coupled to the actuators and the sensors and further includes a memory and a processor, and an application stored in the memory. When executed by the processor, the application executes a multivariable control algorithm to determine actuator manipulated variable values to control in part the burners based on data received from the sensors and based on a plurality of gain values. The application also executes an adaptation algorithm to change an actuator manipulated variable value, to maintain the changed manipulated variable value for a pre-determined period of time, to determine a change in data received from the sensors, to determine a gain value based on the changed manipulated variable value and the change in data received from the sensors, and to provide the determined gain value to the multivariable control algorithm.

20 Claims, 8 Drawing Sheets

SMART FIRING CONTROL IN A RANKINE CYCLE POWER PLANT

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

The simple steam cycle is one of the main processes for producing electricity, and power plants of various ages are being operated using the simple steam cycle, also to produce power. In some contexts, the simple steam cycle may be referred to as a Rankine cycle. The simple steam cycle generally refers to a system having a boiler producing steam, a steam turbine that converts the steam to mechanical energy, a generator that converts the mechanical energy to electrical energy, and a condenser for absorbing waste heat and recycling the water within the system. While newer power plants may have more energy efficient features, the efficiency of the fuel to electricity conversion of the steam cycle still only averages from about 35% to about 40% in practice. Improvements in the efficiency of the system have generally focused on energy recovery. For instance, feed water heating using steam from the steam turbines has been used to increase the feedwater temperature to the boiler, increasing the efficiency of the steam production in the boiler. However, existing plants may have limited options for improving the energy efficiency of the system due to constraints on the feasibility of retrofitting existing equipment. Common efficiency boosting designs may only be available upon the replacement of major system components, leading to significant costs and lost operating time during the retrofitting process.

In addition, the operation of a steam cycle power plant must consider the environmental effects of pollutant emissions from the boiler. A number of pollutants can be produced by the combustion of fuel in the boiler including carbon monoxide, carbon dioxide, sulfur dioxide, and nitrogen oxides (NOx). In some instances, attempts at increasing the efficiency and/or output of the system can result in increased pollutant production.

SUMMARY

In an embodiment, a multivariable control system for controlling a plurality of burners of a boiler in a steam cycle system is disclosed. The system comprises a plurality of actuators affecting the operation of the burners, a plurality of sensors sensing control variable values in the boiler, a control system coupled to the actuators and the sensors and comprising a memory and a processor, and an application stored in the memory. When executed by the processor the application executes a multivariable control algorithm to determine manipulated variable values to send to the actuators to control in part the burners while in-operation based on control variable data received from the sensors and based on a plurality of gain values and executes an adaptation algorithm while the burners are in-operation to change a manipulated variable value sent to one of the burners from a first value to a second value, to maintain the manipulated variable value at the second value for a pre-determined period of time, to determine a change of a control variable value received from the sensors, to return the manipulated variable value to the first value, to determine a gain value based on a difference between the first value of the manipulated variable and the second value of the manipulated variable and based on the change in control variable data received from the sensors, and to provide the determined gain value to the multivariable control algorithm.

In an embodiment, a method of controlling burners of a boiler in a steam cycle system is disclosed. The method comprises determining that the state of the boiler is amenable to conducting an adaptation cycle, sending a first manipulated variable value determined by a multivariable control algorithm to a burner actuator, and receiving a first set of control variable sensed values from the boiler after waiting a predetermined time duration after sending the first manipulated variable value to the burner actuator. The method further comprises determining a second manipulated variable value by the multivariable control algorithm based on the first set of control variable sensed values, sending a third manipulated variable value that is determined by an adaptation algorithm to the burner actuator after receiving the first set of control variable sensed values, wherein the third manipulated variable value is different from the second manipulated variable value and is different from the first manipulated variable value, and receiving a second set of control variable sensed values from the boiler after waiting the predetermined time duration after sending the third manipulated variable value to the burner actuator. The method further comprises determining a calculated burner gain value based at least in part on the first set of control variable sensed values, the second set of control variable sensed values, the first manipulated variable value, and the third manipulated variable value, updating the multivariable control algorithm with the calculated burner gain value, determining a fourth manipulated variable value by the multivariable control algorithm based on the calculated burner gain value, and sending the fourth manipulated variable value to the burner actuator.

In an embodiment a computer program product for adapting a gain of a multivariable control algorithm to control a burner in a boiler in an industrial process is disclosed. The computer program product comprise a computer readable storage medium having a computer usable program code embodied therein, the computer usable program code to execute an adaptation algorithm while the burner in the boiler is in-operation to change a manipulated variable value sent to the burner from a first value to a second value, to maintain the manipulated variable value at the second value for a predetermined period of time, to determine a change in control variable data received from a plurality of boiler sensors, to return the manipulated variable value to the first value, to determine a gain value based on a difference between the first value and the second value and based on the change in control variable data received from the boiler sensors, and to provide the determined gain value to a multivariable control algorithm that controls the burner.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
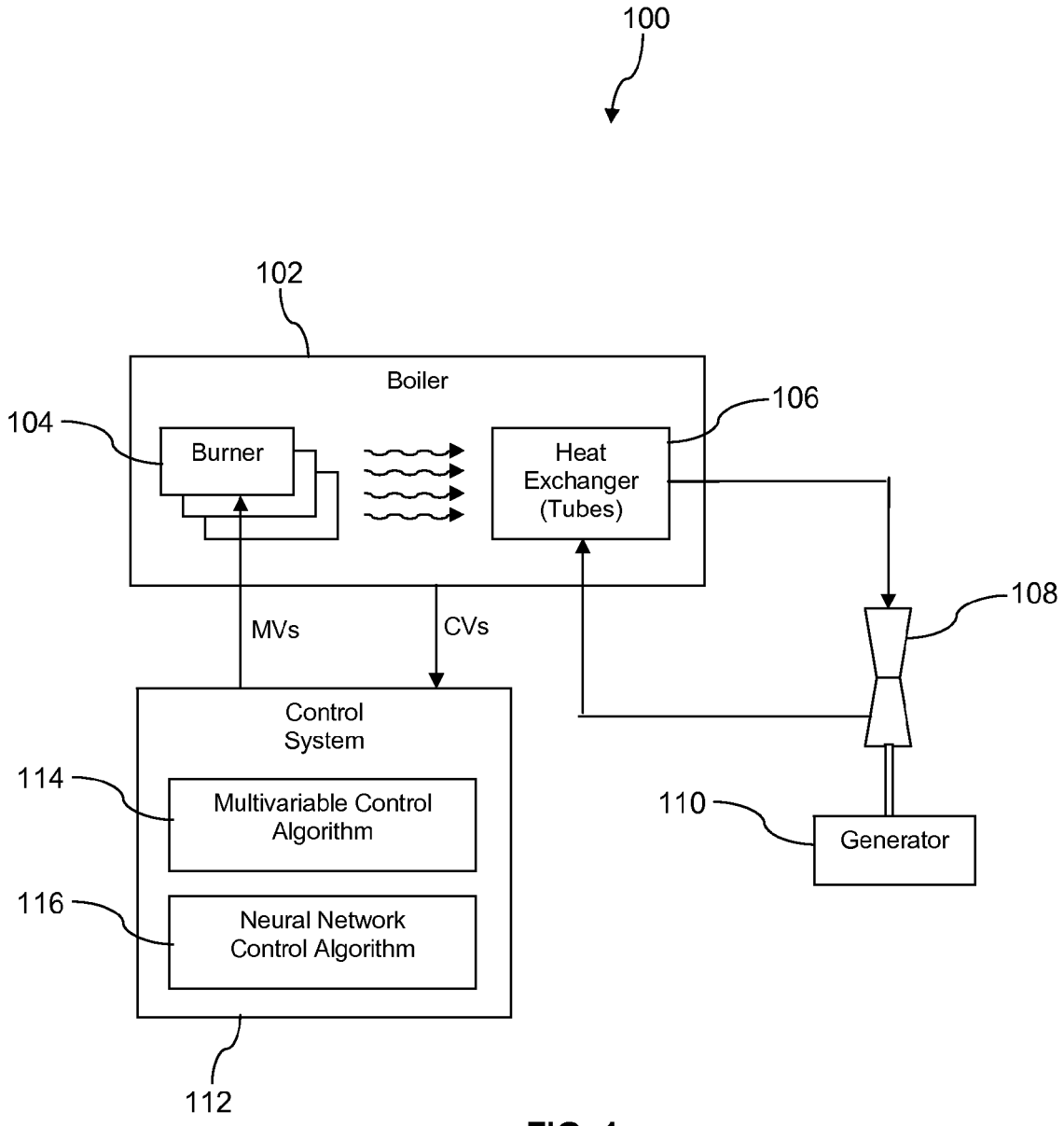
FIG. 1 is an illustration of a Rankine cycle power plant and associated control system according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The use of the system and methods disclosed herein may promote improved boiler firing in a steam cycle system. A boiler in a steam cycle system may be operated to achieve a plurality of operating parameter objectives concurrently. For example, it may be desirable to achieve a heat rate objective, to achieve a nitrogen-oxygen compounds (nitrogen oxides, referred to generally as NOx compounds or simply NOx) emission objective, to achieve a carbon monoxide (CO) emission objective at the same time that the steam cycle system supports a specific electrical power generation load. When initially commissioned for operation the gains of an automated control system for controlling the steam cycle system may be tuned and/or optimized for operation, but over time the system changes and those gains may no longer be suitable for achieving the operating parameter objectives. For example, the coal used to fire the burners in the boiler of the steam cycle system may change. The mills that pulverize the coal to dust may change. The tubes that feed the coal dust to the burners may erode. Under some circumstances, for example, as the boiler ages and changes physically, the homogenous stream of coal and air in the burner fuel pipes may turn into coal ropes, an undesirable condition that may result in coal maldistribution.

Additionally, other changes of operation can result in coal maldistribution. For example, the distribution of coal to a number of burners from a common pulverizer is subject to change based on coal flow and/or air flow through the pulverizer. For example, some pulverizers have a single exhaust for the coal/air mixture. This pulverizer may likely service multiple burners. Therefore the coal pipe is commonly run to a splitter which divides into two pipes, and each of these pipes may also have a splitter and so on with each final coal pipe leading to a coal burner in the boiler. A common device used as a coal splitter is a riffle plate. This plate may be positioned during a test procedure to achieve an even split of coal flow at a specific pulverizer coal flow and air flow rate. The design of the riffle plate takes into account the non-homogeneous quality of coal flow in pipes, such as roping which can be viewed as a spiral like rope of coal particles traveling down the wall of the pipe. The object of the riffle plate is to disperse the coal particles, such that a more homogeneous coal/air mixture can be evenly split. The effectiveness of the splitter is subject to the coal and air flow rates with the resulting uneven coal distribution contributing to the problem and the need for this solution. Not all pulverizers have a single exit pipe, as some have multiple exit pipes, one for each burner. Such pulverizers also have challenges in maintaining even coal distribution to each exit pipe. This distribution is also sensitive to the total coal flow and air flow through the pulverizer. Thus, in an embodiment, a coal distribution sub-system that is initially appropriately adjusted for desired coal distribution may change over time and result in coal maldistribution.

The maldistribution of coal can result in oxygen imbalances within a firebox of the boilers, and these oxygen imbalances in turn can result in regions of high carbon monoxide and unburned carbon in oxygen depleted areas of the firebox and regions of high nitrogen oxides in regions of excessive oxygen concentration areas of the firebox. All of these physical changes of the burner and boiler system can lead to the gains that were calibrated when the steam cycle system was originally commissioned being out of tune or sub-optimized.

An adaptation algorithm is taught herein that involves perturbing or stepping a burner manipulated variable, determining a change in one or more control variables of the boiler, calculating associated gain parameters, and returning the burner manipulated variable to its unperturbed value. As used herein, a manipulated variable corresponds to some aspect of the physical plant that can be adjusted, for example, under the control of the automated control system. For example, a manipulated variable may include a burner register or burner damper position, a pulverized coal fuel feed rate, and other physical settings. A manipulated variable may also include some aspect of the physical plant that can be adjusted manually, possibly according to a recommendation of the automated control system. As used herein, a control variable is associated with an operation parameter or sensed physical condition of the boiler that the automated control system seeks to maintain at or below a desired value, for example a nitrogen oxides emission level, a carbon monoxide emission level, an oxygen concentration gradient, a steam outlet temperature, and other parameters.

The adaptation algorithm holds the perturbed burner manipulated variable value for a period of time effective to allow the boiler to approach a steady state and to collect a plurality of sensed values from each of a plurality of control variables, for example to collect several samples of sensed value from each control variable which can be averaged to attenuate the effect of sensor noise in gain calculations. The sensed values of each control variable are averaged, and this control variable average value is compared to a pre-perturbation control variable value to determine a change in the control variable that may be imputed to the perturbed burner manipulated value. A gain value associated with the subject control variable can be calculated that relates change in the control variable to change in a manipulated variable. Because change in a single burner manipulated value may change a plurality of burner control variables, a plurality of gains may be determined for each burner manipulated variable. The gains are provided to the automated control system, and the automated control system may thereafter control the steam cycle system based at least in part on these gains. In some contexts, this may be referred to as an on-line stepping adaptation algorithm or an in-operation adaptation algorithm. In some contexts, this may be referred to as smart firing control.

The adaptation algorithm may first determine if the steam cycle system is at an operating point that is safe or otherwise amenable to performing the on-line stepping adaptation algorithm. The adaptation algorithm may apply a filter, for example a first order filter and/or a low-pass filter, to the calculated gains before they are provided to the automated control system. Additionally, a calculated gain may be compared to the previously defined gain, and if the relative difference between the two gains exceeds a threshold, the calculated gain may not be provided to the automated control system. Additionally, in an embodiment, if the value of a calculated gain is not zero but is less than a pre-defined threshold value, the gain provided to the automated control system may be set to zero to avoid introducing a phantom functional relationship between a manipulated variable and a control variable that is not extant. This may be referred to in some contexts as nulling a gain.

In an embodiment, the automated control system may comprise a multivariable control algorithm and a neural network control algorithm, and control of the boiler and/or of the steam cycle system may be provided by the aggregate of the multivariable control algorithm and the neural network control algorithm. In this case, the on-line stepping adaptation algorithm may also include revising the tuning of the neural network control algorithm. The neural network control algorithm may predict a value of one or more of the control variables based on the manipulated variables. A difference between the predicted values of the control variables and the sensed values of the control variables determined during the on-line stepping adaptation algorithm may be determined, and this difference may be used going forward to correct or offset the determinations of the neural network control algorithm accordingly.

While the descriptions herein are related to controlling a boiler in a steam cycle system, one skilled in the art of industrial automated control will readily appreciate that the teachings herein are adaptable to other industrial processes. For example, the on-line stepping adaptation approach may be employed in hydrocarbon refinery plants, chemical synthesis plants, glass manufacturing plants, breweries, food processing plants, and other industrial plants. The on-line stepping adaptation approach may be employed in other processes that employ a multivariable control system to command a plurality of manipulated variables to drive a plurality of control variables of the subject process to desired values.

Turning now to FIG. 1, a system 100 is described. In an embodiment, the system 100 comprises a boiler 102, a steam turbine 108, an electrical generator 110, and a control system 112. The boiler 102 comprises one or more burners 104 and heat exchanger 106. The boiler 102 provides energized steam to drive the turbine 108 and receives de-energized steam or condensed water back from the turbine 108. The rotating turbine 108 is mechanically coupled to the generator 110 such that as the turbine 108 rotates, the generator 110 rotates and generates electrical power. It is understood that the system 100 may be considerably more complex than illustrated schematically in FIG. 1. For example, the steam cycle may comprise one or more feedwater heaters, superheat circuits, reheat circuits not shown. For example, the turbine 108 may have multiple stages or comprise multiple separate mechanically coupled turbines. The burners 104 promote controlled combustion of fuel in a firebox or combustion chamber of the boiler 102 that heats water contained within the heat exchanger 106, for example water circulated through tubes in the firebox of the boiler 102.

The boiler 102 may be controlled by the control system 112 by transmitting desired values of manipulated variables (MVs) to the burners 104 and/or to other equipment coupled to the boiler 102. A manipulated variable is associated with an actuator that adjusts an aspect of operation of the boiler 102. By adjusting the value that the control system 112 outputs or transmits to the manipulated variable, the control system 112 adjusts the physical state of the actuator, for example incrementally opening or closing a valve. The manipulated variables may comprise one or more of a burner tilt, a burner register position, a burner damper position, a burner fuel feed motor, and other actuated components associated with the boiler 102.

The boiler 102 may comprise a plurality of burners 104, each burner 104 comprising a plurality of ports or fuel outlets. A single actuator may control the flow of fuel to two or more burners 104. A single actuator may control the flow of air for mixing with the fuel of two or more burners 104 in the firebox. Alternatively, a single actuator may control the flow of fuel to one burner 104 that comprises a plurality of ports or fuel outlets.

The control system 112 receives control variable (CV) data from sensors located in and/or proximate to the boiler 102. The control variables may comprise one or more of a concentration level of nitrogen oxides, a concentration level of carbon monoxide, a concentration level of oxygen, a temperature, a pressure, a flow rate, and other sensed values. In an embodiment, one or more of the sensors may generate a processed value. For example, a level of oxygen may be sensed at different locations within the boiler 102, and an oxygen sensor may determine a gradient of the oxygen level across the boiler 102.

When an industrial plant such as the system 100 is brought into operation the control system 112 may be adjusted and or calibrated to provide the desired control functions. For example, a multivariable control algorithm 114 may be tuned and/or adjusted to provide the desired control on original commissioning of the system 100. Over time, however, the initial calibrations may become maladapted. For example, as the system 100 operates, physical properties of the boiler 102 may change. The burner tubes of the burners 104, for example, that may feed pulverized coal mixed with air to a firebox of the boiler 102 may erode from the passage of the coal particles. The control system 112 of the present disclosure provides for adapting the calibrations of the multivariable control algorithm 114 while the system 100 continues to operate, for example generating electrical power.

In an embodiment, the multivariable control algorithm 114 provides for transmitting a perturbed value of a manipulated variable to the boiler 102 during an adaptation mode of operation. As used herein, the term perturbed value or perturbed manipulated variable value means a value that is different from the value that would ordinarily be determined by the multivariable control algorithm 114 when operating in a steady state control mode of operation given the sensed control variable values at the time of adaptation. When operating in a steady state control mode of operation, the multivariable control algorithm 114 compares sensed control variable values returned from sensors to desired control variable values and adapts the manipulated variables so as to reduce the difference between the sensed and the desired control variable values. When the system 100 is operating in steady state the changes in the manipulated variables are relatively small, for example less than 1% of the range of the values that the manipulated variables may assume. When the multivariable control algorithm 114 operates in an adaptation operation mode, the change in the manipulated variable values may be markedly greater than the change commanded by the multivariable control algorithm 114 during normal operation, for example greater than 3% of the range of the values that the manipulated variables may assume. This may be referred to as stepping the manipulated variable. Also, in the adaptation operation mode, the change in the manipulated variable values may have a sense of change—plus or minus—that is different from the sense of change that would be commanded by the multivariable control algorithm 114. It is in these ways that the term perturbed value is said to be different from the value that would ordinarily be determined by the multivariable control algorithm 114 when operating in the steady state control mode of operation.

After the multivariable control algorithm 114 perturbs one of the manipulated variables and continues to output this perturbed value for a time duration that is effective to allow the boiler 102 to reach steady state, the change in sensed control variable values may be imputed to the change presented by the perturbed value. The time duration that is effective to allow the boiler 102 to reach a steady state may be referred to as a settling time. In an embodiment, the multivariable control algorithm 114 may perturb one of the manipulated variables and continue to output the perturbed value for a duration of about one and a half times the settling time, a duration of about two times the settling time, a duration of three times the settling time, or alternatively a duration of about four times the settling time to allow the system 100 to fully adjust to the perturbed value and approach steady state operation. A gain may be calculated as $$\text{Gain}_\alpha=\Delta CV/\Delta MV=(CV_a-CV_b)/(MV_a-MV_b) \quad \text{Eq. 1A}$$

where $CV_a$ is the control variable value at a first time a, $CV_b$ is the control variable value at a second time b, $MV_a$ is the manipulated variable value at the first time a, and $MV_b$ is the manipulated variable value at the second time b. When this gain value is known, the multivariable control algorithm 114 may adapt the subject manipulated variable value more accurately to more closely approach the desired sensed control variable value. Note that the gain determined through this perturbation of the manipulated variable can take into account physical changes in the system 100 without having to understand, quantify, or model these physical changes explicitly.

In an embodiment, the subject manipulated variable that has been perturbed may be returned to the value $MV_a$ it had at the first time, the value $MV_a$ may continue to output the value $MV_a$ for the time duration effective to allow the boiler 102 to reach the steady state, and the gain may be calculated as:

$$\text{Gain}_\beta=\Delta CV/\Delta MV=(CV_b-CV_c)/(MV_b-MV_a) \quad \text{Eq. 2A}$$

where $CV_c$ is the control variable value at the third time c when the manipulated variable has been returned to the value $MV_a$ and the time duration effective to allow the boiler 102 to reach the steady state has been allowed to pass.

It is understood that, in an embodiment, the gains may be calculated in a different way. For example, the gains may be calculated as the inverses of Eq. 1A and Eq. 2A:

$$\text{Gain}_\alpha=\Delta MV/\Delta CV=(MV_a-MV_b)/(CV_a-CV_b) \quad \text{Eq. 1B}$$

$$\text{Gain}_\beta=\Delta MV/\Delta CV=(MV_b-MV_a)/(CV_b-CV_c) \quad \text{Eq. 2B}$$

In combination with the present disclosure, one skilled in the art will readily be able to choose what form of the gain calculation to employ.

The two gains calculated in this way—the gain calculated according to Eq. 1A or Eq. 1B and the gain calculated according to Eq. 2A or Eq. 2B—may be averaged to determine the subject gain Gain calculated as:

$$\text{Gain}=(\text{Gain}_\alpha+\text{Gain}_\beta)/2 \quad \text{Eq. 3}$$

In a particular embodiment, a gain may be calculated using a single step, for example as defined by Eq. 1A or Eq. 1B alone or a gain may be calculated using two steps, for example as defined by Eq. 3.

In practice the adaptation of the gains employed by the multivariable control algorithm 114 may be more complicated than suggested by this simple illustration. In practice, a plurality of manipulated variables are under control, and adjustments in any one of the manipulated variables can result in changes in the steady state of a plurality of the control variables. Hence, in practice a matrix of gains may be determined during an adaptation cycle. The on-line stepping adaptation taught herein promotes adapting the gains of the multivariable control algorithm 114 more frequently than would be practical otherwise. At present, without the benefit of the teachings herein, the system 100 may be taken off-line about once per year for recalibration and/or recommissioning, a process that may consume one or several days to complete, during which the system 100 is not productive. Further, the on-line stepping adaptation taught herein may promote identifying cause and effect relationships between manipulated variables and control variables, for example the gains.

Figure 2:
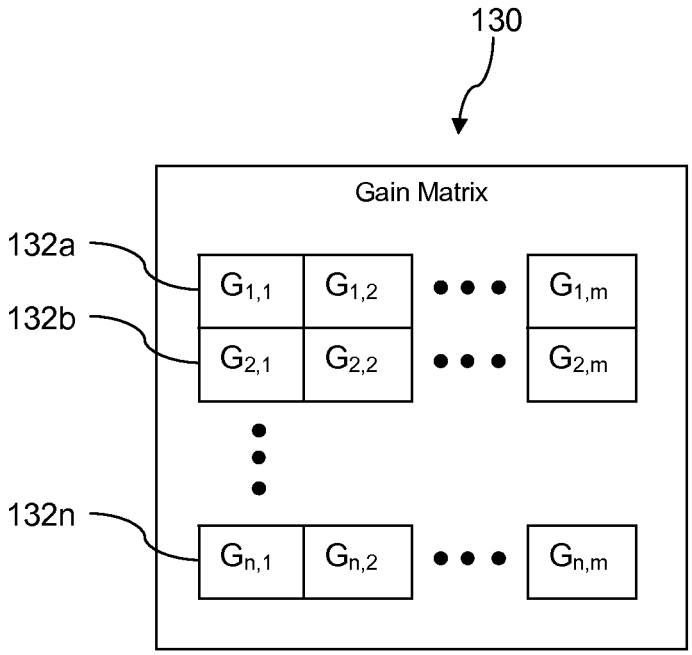
FIG. 2 is an illustration of a gain matrix according to an embodiment of the disclosure.

Turning now to FIG. 2, a gain matrix 130 is described. It is understood that while the gains are described in terms of a two-dimensional matrix, any data structure may be used to store the gains. For example, in an embodiment, all of the gains associated with a first operating regimen of the system 100 may be defined and/or stored in a first one-dimensional vector and all of the gains associated with a second operating regimen of the system 100 may be defined and/or stored in a second one-dimensional vector. The first operating regimen of the system 100 may be identified with a first electrical load supplied by the generator 110, and the second operating regimen of the system 100 may be identified with a second electrical load supplied by the generator 110, where the first electrical load is different from the second electrical load. Other operating regimens may be identified or associated with other conditions such as a different supply of burner fuel, a different configuration of the system 100, different regulatory requirements, and other different conditions. In an embodiment a plurality of gain matrices 130 may be defined, each gain matrix 130 associated with a different operating regimen. Such a plurality of two-dimensional gain matrices may be conceptualized as a three-dimensional gain matrix. Notwithstanding, any data structure may be used to store all the gains.

The multivariable control algorithm 114 may use the gain matrix 130 and the sensed control variable values to determine the manipulated variable values to transmit to the boiler 102. In different operating regimens, the multivariable control algorithm 114 may use other gain matrices 130 having different values to determine, at least in part, the manipulated variable values to transmit to the boiler 102.

A first row of the gain matrix 130 may be referred to as a first gain vector **132*a*, a second row of the gain matrix 130 may be referred to as a second gain vector 132*b*, and a third row of the gain matrix 130 may be referred to as a third gain vector 132*n*. It is understood that the gain matrix 130 may comprise any number of gain vectors 132. The first gain vector 132*a* may be the gains associated with perturbing a first manipulated variable, for example a gain $G_{1,1}$ may be associated with change in a first control variable in response to perturbation of the first manipulated variable, a gain $G_{1,2}$ may be associated with change in a second control variable in response to perturbation of the first manipulated variable, and a gain $G_{1,m}$ may be associated with change in a third control variable in response to perturbation of the first manipulated variable. The second gain vector 132***b* may be the gains associated with perturbing a second manipulated variable, for example a gain $G_{2,1}$ may be associated with change in the first control variable in response to perturbation of the second manipulated variable, a gain $G_{2,2}$ may be associated with change in the second control variable in response to perturbation of the second manipulated variable, and a gain $G_{2,m}$ may be associated with change in a third control variable in response to perturbation of the second manipulated variable. The third gain vector 132*n* may be the gains associated with perturbing the third manipulated variable, for example a gain $G_{n,1}$ may be associated with change in the first control variable in response to perturbation of the third manipulated variable, a gain $G_{n,2}$ may be associated with change in the second control variable in response to perturbation of the third manipulated variable, and a gain $G_{n,m}$ may be associated with change in the third control variable in response to perturbation of the third manipulated variable.

In an embodiment, the adaptation is performed by an adaptation algorithm. The adaptation algorithm may be part of the multivariable control algorithm 114 or may be an independent component of the control system 112. The determination of gains may be based on receiving a plurality of sensed control variable values, averaging this plurality of sensed control variable values, and using the average value to determine the gain. Thus Eq. 1 may be modified to $$\text{Gain} = \overline{\Delta CV} / \Delta MV = \left( CV_a - \left[ \frac{1}{(r)} \sum_{i=1}^{r} CV_i \right] \right) \Big/ (MV_a - MV_b) \qquad \text{Eq. 4}$$

where $CV_a$, $MV_a$, and $MV_b$ have the meanings defined above and $CV_i$ are a series of r sensed control variable values captured after the manipulated variable value $MV_b$ has been sent to the burner 104 and held by the control system 112 for a time duration effective to allow the boiler 102 to reach steady state. The number r of sensed control variable values that are captured for averaging may be selected based on design considerations such as calculation complexity, noise profile of sensors, adaptation speed requirements, and other considerations. Using an average of the sensed control variable values may smooth and/or attenuate sensor noise, which may provide a more accurate gain determination. Likewise, Eq. 2A or Eq. 2B may be modified along similar lines that one skilled in the art, in combination with the present disclosure, would readily understand.

In an embodiment, the adaptation algorithm may update the gain matrix 130 with filtered values. For example, a first order filter may be applied to the gain calculated by either of Eq. 1A or Eq. 1B, Eq. 3, and/or Eq. 4, and the filtered value may then be used to update the gain matrix 130. Alternatively, a low pass filter may be applied to the gain calculated by either of Eq. 1A or Eq. 1B, Eq. 3 and/or Eq. 4, and the filtered value used to update the gain matrix 130. For example, the gain to assign to the gain matrix 130 may be calculated as:

$$\text{Updated Gain}_2 = (1-\alpha)\text{Updated Gain}_1 + \alpha(\text{Calculated Gain}) \qquad \text{Eq. 5}$$

where $0<\alpha\leq 1$, Calculated Gain is the gain calculated based on perturbing or stepping a manipulated variable during the present iteration of the adaptation cycle, Updated $\text{Gain}_1$ is the value calculated by the filter in the previous iteration of the adaptation cycle, and Updated $\text{Gain}_2$ is the value calculated by the filter in the present iteration of the adaptation cycle. As the factor $\alpha$ gets smaller, the rate of change of the Updated Gain that is stored in the gain matrix 130 is reduced and the influence of sensor noise on gain is reduced. In combination with the present disclosure, one skilled in the art will readily be able to select a factor $\alpha$ that is effective to smooth the gains over a succession of adaptation cycles.

Figure 3:
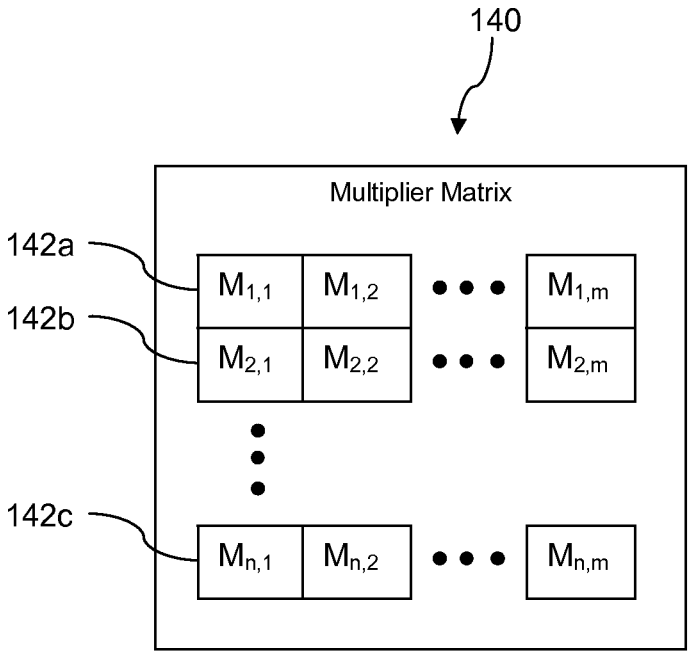
FIG. 3 is an illustration of a multiplier matrix according to an embodiment of the disclosure.

Turning now to FIG. 3, a multiplier matrix 140 is described. In an embodiment, the control system 112 further executes a neural network control algorithm 116. The neural network control algorithm 116 may provide some of the manipulated variable values output by the control system 112 to the boiler 102 and/or burners 104. As is known by those skilled in the art, neural networks may be adapted to learn over time when additional training data is applied based on measured values. In practice neural networks may evolve and learn slowly, depending on the rate at which additional training data is applied. The present disclosure contemplates using the stepping of manipulated variable values during the adaptation cycle to more rapidly correct the output from the neural network algorithm 116. The neural network algorithm 116 is designed to predict the value of one or more of the control variables and to adjust the manipulated variable values based on these predictions. In an embodiment, a change in the predicted value of a control variable determined by the neural network algorithm 116 is compared to a change in the sensed value of the control variable and a corrective multiplier is determined based on the comparison. For example, in an embodiment, a multiplier may be determined as:

$$\text{Multiplier} = \Delta CV_{sensed} / \Delta CV_{predicted} \qquad \text{Eq. 6}$$

where $\Delta CV_{sensed}$ is the change in the sensed value of the control variable and $\Delta CV_{predicted}$ is the change in the predicated value of the control variable. The multiplier may then be used in combination with the predicted control variable value to adjust or adapt the processing of the neural network algorithm 116 and to contribute to the neural network algorithm 116 producing more suitable manipulated variable values for controlling the boiler 102 and/or burners 104. In an embodiment, the multiplier may be calculated as the reciprocal of the expression given in Eq. 6

As with the gains, the multipliers may be stored in a multiplier matrix 140. It is understood that while the multipliers are described in terms of a two-dimensional matrix, any data structure may be used to store the multipliers. For example, in an embodiment, the multipliers associated with the first operating regimen of the system 100 may be defined and/or stored and/or defined in a fourth one-dimensional vector and all of the multipliers associated with a second operating regimen of the system 100 may be defined and/or stored in a fifth one-dimensional vector.

A first row of the multiplier matrix 140 may be referred to as a first multiplier vector 142*a*, a second row of the multiplier matrix 140 may be referred to as a second multiplier vector 142*b*, and a third row of the multiplier matrix 140 may be referred to as a third multiplier vector 142*n*. It is understood that the multiplier matrix 140 may comprise any number of multiplier vectors 142. The first multiplier vector 142*a* may be the multipliers associated with perturbing a first manipulated variable, for example a multiplier $M_{1,1}$ may be associated with a ratio of the sensed value to the predicted value of a first control variable determined at the time of the perturbation of the first manipulated variable, a multiplier $M_{1,2}$ may be associated with a ratio of the sensed value to the predicted value of a second control variable determined at the time of the perturbation of the first manipulated variable, and a multiplier $M_{1,m}$, may be associated with a ratio of the sensed value to the predicted value in a third control variable determined at the time of the perturbation of the first manipulated variable. The second multiplier vector 142*b* may be the multipliers associated with perturbing a second manipulated variable, for example a multiplier $M_{2,1}$ may be associated with a ratio of the sensed value to the predicted value of the first control variable determined at the time of the perturbation of the second manipulated variable, a multiplier $M_{2,2}$ may be associated with a ratio of the sensed value to the predicted value of the second control variable determined at the time of the perturbation of the second manipulated variable, and a multiplier $M_{2,m}$ may be associated with a ratio of the sensed value to the predicted value of a third control variable determined at the time of the perturbation of the second manipulated variable. The third multiplier vector 142*n* may be the multipliers associated with perturbing the third manipulated variable, for example a multiplier $M_{n,1}$ may be associated with a ratio of the sensed value to the predicted value of the first control variable determined at the time of the perturbation of the third manipulated variable, a multiplier $M_{n,2}$ may be associated with a ratio of the sensed value to the predicted value of the second control variable determined at the time of the perturbation of the third manipulated variable, and a multiplier $M_{n,m}$ may be associated with a ratio of the sensed value to the predicted value of the third control variable determined at the time of the perturbation of the third manipulated variable.

As with the determination of gains described further above, the determination of the multipliers may be filtered before updating the multiplier matrix 140. For example, the multipliers determined in the manner described above may be filtered with a first order filter and/or low pass filtered before updating the multiplier matrix 140.

Figure 4A:
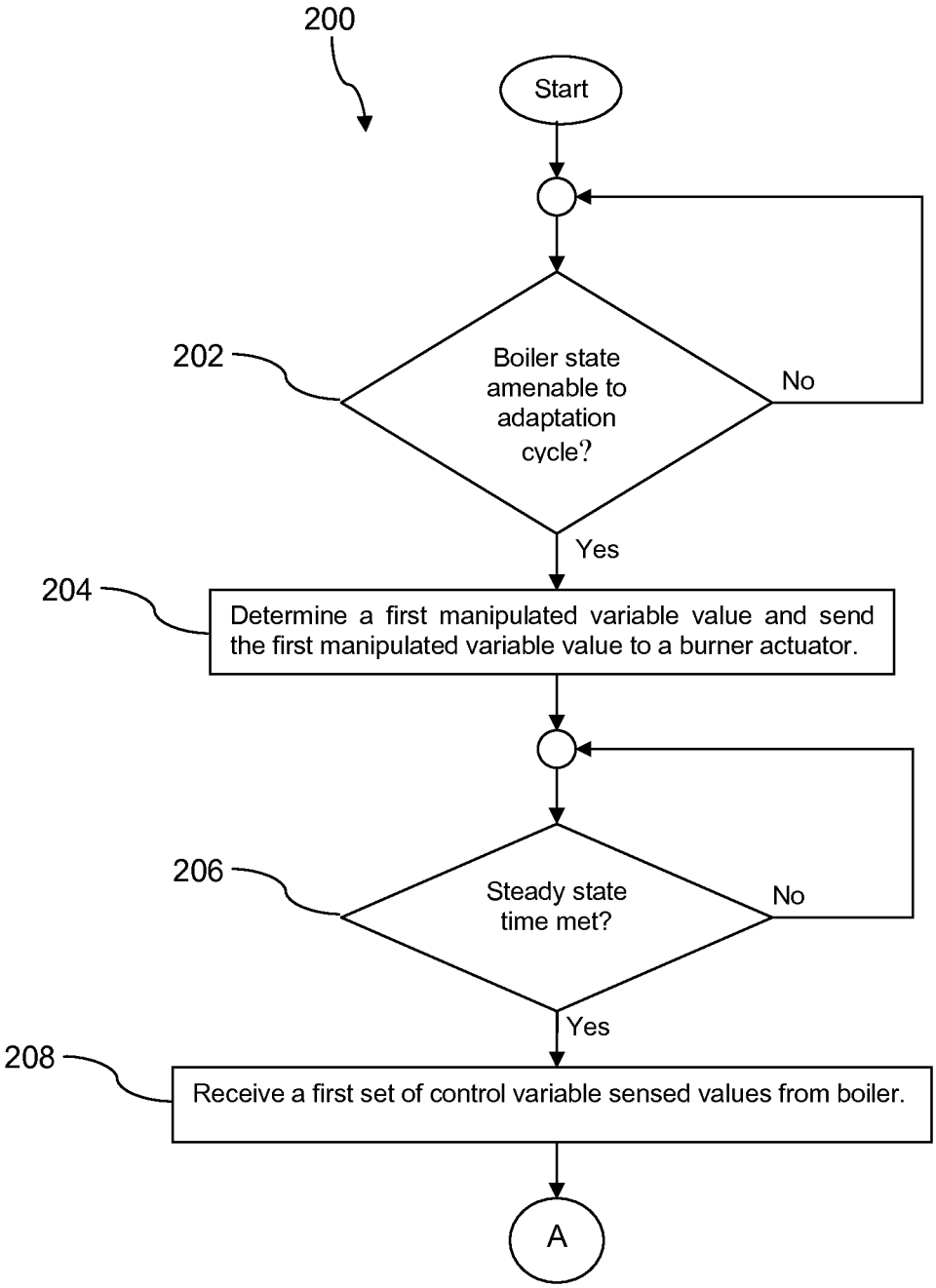
FIG. 4A is a portion of a flowchart of a method according to an embodiment of the disclosure.
Figure 4B:
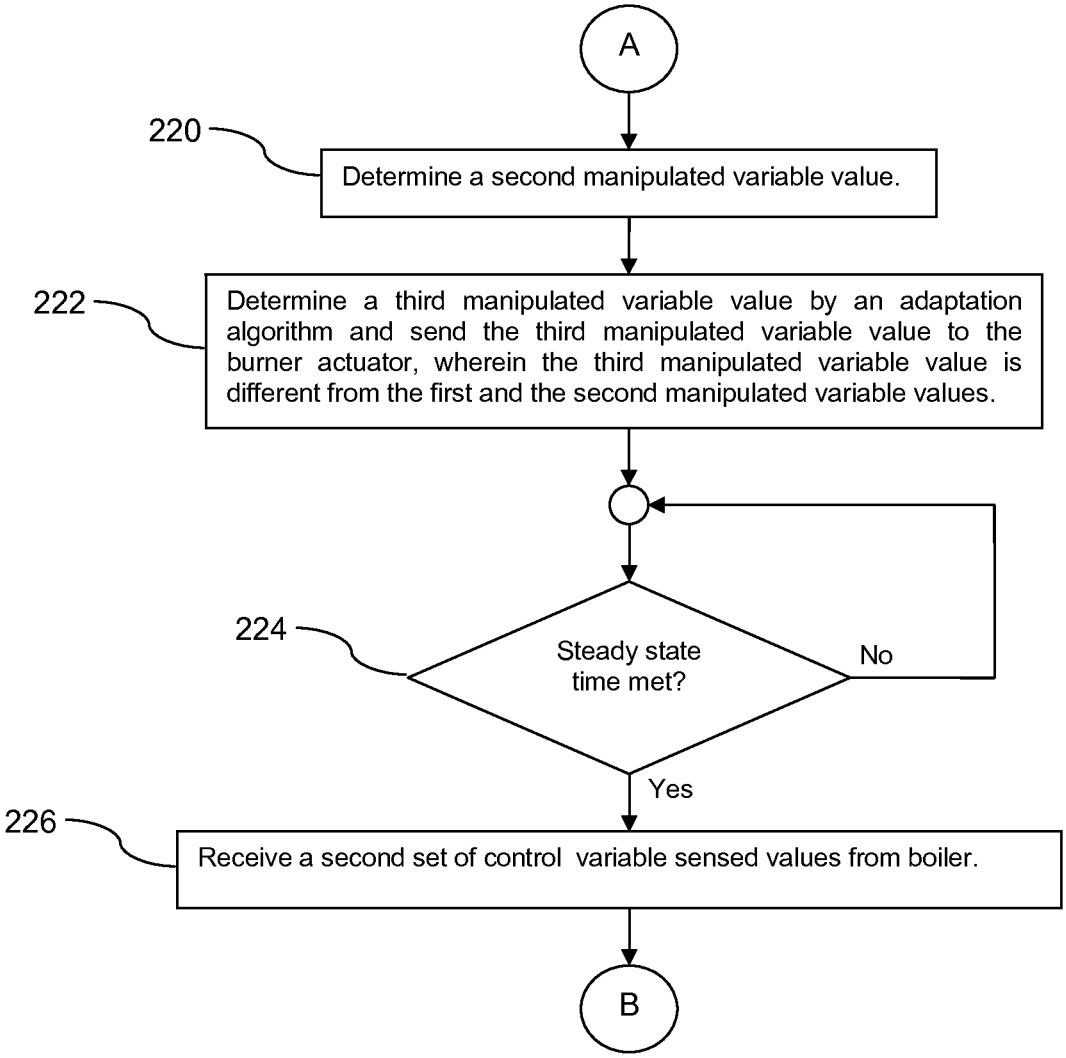
FIG. 4B is a portion of a flowchart of a method according to an embodiment of the disclosure.
Figure 4C:
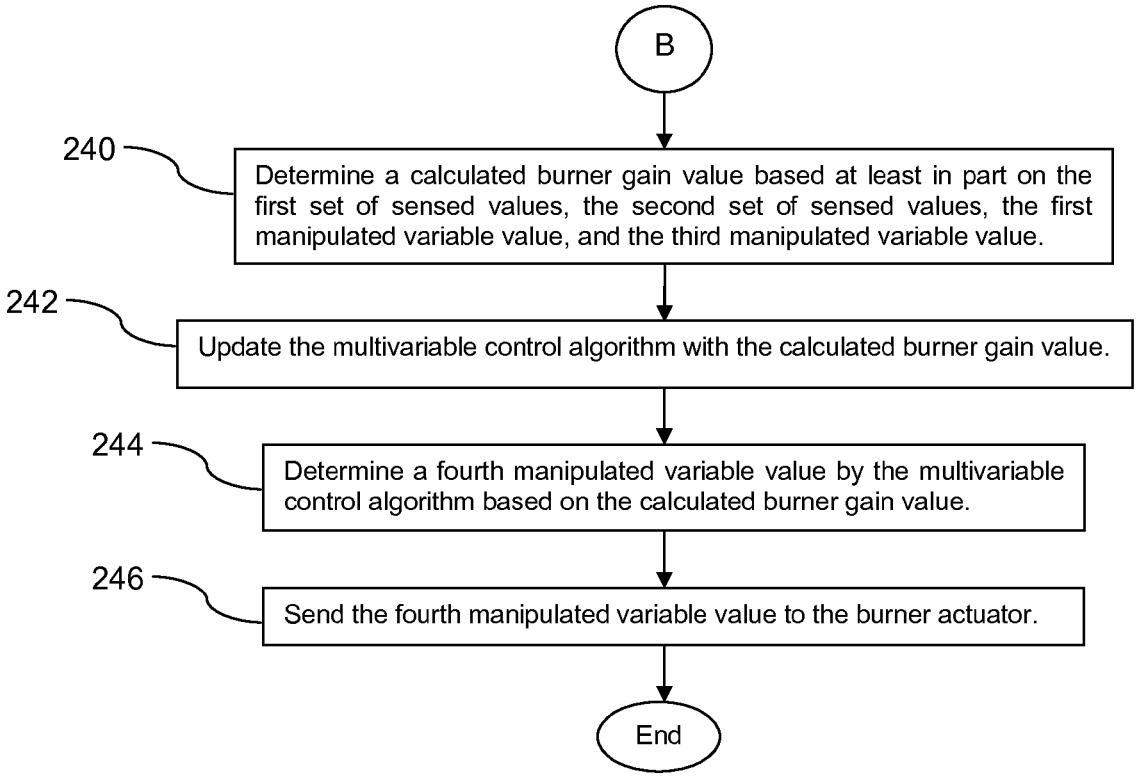
FIG. 4C is a portion of a flowchart of a method according to an embodiment of the disclosure.

Turning now to FIG. 4A, FIG. 4B, and FIG. 4C, a method 200 is described. The method 200 may be initiated by an operator and/or engineer electing to execute an adaptation cycle, for example by selecting a control provided in an interface of the control system 112. At block 202, a determination is made whether or not the state of the boiler 102 and/or the system 100 is amenable and/or suitable for conducting an adaptation cycle. In some operating modes, for example if the system 100 is not in steady state, the conditions may not be right for conducting an adaptation cycle. A number of conditions may be considered in making the determination including safety conditions, personnel staffing levels, the projected electrical load demand, the current time relative to the personnel work schedule, and others. In an embodiment, for example, it may be preferred that an adaptation cycle start within a short time threshold after an operator work shift begins so that the adaptation cycle may complete before the operator work shift has completed. Provided the state of the boiler 102 and/or the system 100 is amenable to conducting an adaptation cycle, the method 200 proceeds to block 204.

In an embodiment, the decision of block 202 examines a permission associated with the subject manipulated variable and/or pair of manipulated variable-control variable. When the permission is true or has a value of '1', the adaptation for the subject gain is permitted; when the permission is false or has a value of '0', the adaptation for the subject gain is rejected. In this way, a simple data table or data file may be defined to control the adaptation cycle without having to rewrite, compile, and deploy complicated adaptation software.

In an embodiment, a statistical analysis is made of the electrical load supplied by the generator 110 in a subject operating regimen to determine a mean or average supplied electrical load. The present electrical load supplied by the generator 110 is compared to the mean or average supplied electrical load, and if the present electrical load is not acceptably close to the mean or average, entering upon the adaptation cycle may be rejected. The control variable values may also be compared to normal values during the decision making associated with block 202, and if the control variable values are outside of acceptable ranges or if one or more sensors associated with the control variables are out of service, the adaptation cycle may be rejected. This decision reflects the desire that the gains of the multivariable control algorithm 114 and/or the multipliers of the neural network control algorithm 116 be adopted based on normal operating conditions associated with the subject operating regimen.

At block 204 a first manipulated variable value is determined and sent to the burner 104, for example to a register actuator of the burner 104 or to some other actuator associated with the burner 104 or with the boiler 102. The first manipulated variable value may be a value that is determined by the control system 112 as part of the normal control process, for example as a result of the multivariable control algorithm 114 executing in steady state control mode of operation based on sensed values of the control variables. The control system 112 continues to send or output the first manipulated variable value to the burner 104. This may be referred to in some contexts as holding the first manipulated variable value or holding the first manipulated variable value constant. In an embodiment, a timer may be started and incremented when the processing of block 204 is performed. At block 206, the method 200 determines if the first manipulated variable value has been held constant long enough for the system 100 to approach steady state. In an embodiment, the control system 112 may determine a maximum settling time for the system 100 to reach steady state after introducing a perturbation or a step change into a manipulated variable value. The settling time of the system 100 may be approximated by the sum of the dead time and three times the time constant of the first order lag portion of the system response to the step change in the manipulated variable value. In another embodiment, however, the settling time may be determined in another way. In an embodiment, the settling time of the system 100 may be about ten minutes. In another embodiment, however, the settling time of the system 100 may be a different time duration. When the maximum settling time has been achieved, for example after a timer has marked the passage of the predefined maximum settling time since outputting the first manipulated variable value to the burner 104 and holding that value, the method 200 proceeds to block 208. In an embodiment, the value may be held for at least 125%, at least 150%, at least 200%, or at least 300% of the maximum settling time.

At block 208, a first set of control variable sensed values is received from the boiler 102 and stored for processing later. For example, a sensed value is received from each of a plurality of control variables that are monitored by sensors in and/or associated with the boiler 102. For example, a sensed value of a carbon monoxide concentration in the firebox of the boiler 102 is received, a sensed value of an oxygen gradient across the firebox of the boiler 102 is received, a sensed value of a temperature in the firebox of the boiler 102 is received, a sensed value of a nitrogen oxides concentration in the firebox of the boiler 102 is received, and other sensed values of other control variables are received. In an embodiment, a plurality of sensed values or time samples of each of the control variables are received and stored, and an average of each of the sensed values of the control variables are determined and stored for processing later. For example, a plurality of sensed values of a first control variable are received and an average value of the first control variable is determined; a plurality of sensed values of a second control variable are received and an average value of the second control variable is determined; and so on with the remaining control variables an average may be determined based on a plurality of sensed values. During the process of receiving the sensed values of control variables the control system 112 continues to hold the first manipulated variable value constant. In an embodiment, the sensed values of control variables may be received over a duration of about two minutes. In another embodiment, however, the sensed values of control variables may be received over a different duration of time.

At block 220, the control system 112 determines a second manipulated variable value. For example, the multivariable control algorithm 114 executing according to a steady state operation mode calculates a second manipulated variable value associated with the same actuator based at least in part on the sensed values of the control variables. This second manipulated variable value may be used to perform a safety check before sending a perturbed manipulated variable value to the burner 104. For example, if the perturbed manipulated variable value differs excessively from the second manipulated variable value, the adaptation cycle may be aborted in the interests of maintaining the safety of the system 100. In practice, the value of the second manipulated variable value may be relatively similar to the value of the first manipulated variable value, bearing in mind that the system 100 is presumed to be operating at steady state when the method 200 is started and that the manipulated variable has not been perturbed or stepped at this point in the processing of method 200.

At block 222, a third manipulated variable value is determined by the adaptation algorithm. This may be referred to as a perturbed manipulated variable value or a stepped manipulated variable value. This third manipulated variable value is sent by the control system 112 to the burner 104, for example to the actuator of the burner 104 associated with the subject manipulated variable. The third manipulated variable value is different from the first and second manipulated variable values. For example, in an embodiment, the third manipulated variable value may be about 3% greater than the first manipulated variable value or about 3% less than the first manipulated variable value. Alternatively, in an embodiment, the third manipulated variable value may be 4% greater or less than the first manipulated variable value. Alternatively, in an embodiment, the third manipulated variable value may be 5% greater or less than the first manipulated variable value.

Alternatively, the perturbation or step may be determined as a fixed portion of the full value range of the subject manipulated variable value. For example, the third manipulated variable value may be determined by adding or subtracting about 3% of the total value range of the manipulated variable to the first manipulated variable value; by adding or subtracting about 4% of the total value range of the manipulated variable to the first manipulated variable value; by adding or subtracting or subtracting about 5% of the total value range of the manipulated variable to the first manipulated variable value. It is understood if the subject calculation of the stepped or perturbed value of the manipulated variable lies outside of the maximum or minimum value for that manipulated variable, the third manipulated variable value may be assigned to the value of the nearest maximum or minimum value. As mentioned above, the second manipulated variable value may be relatively similar to if not equal to the first manipulated variable value. In an embodiment, the adaptation algorithm or the multivariable control algorithm 114 compares the third manipulated variable value to the second manipulated variable value, and if the difference between the values is too great, the adaptation cycle may be discontinued or the adaptation cycle for the subject gain may be discontinued and the method may proceed to adopt a different gain.

At block 224, the process 200 waits for the system 100 to approach steady state after the perturbed manipulated variable value is sent to the burner 104 and held. For example, in an embodiment, a timer is initiated in block 222 and begins to mark the passage of time from when the perturbed manipulated variable value is initially output to the burner 104. At block 226, after the system 100 has been allowed to approach steady state, a second set of control variable sensed values are received from the boiler 102 and stored for later processing. For example, a sensed value is received from each of a plurality of control variables that are monitored by sensors in and/or associated with the boiler 102. In an embodiment, a plurality of sensed values or time samples of each of the control variables are received and stored, and an average of each of the sensed values of the control variables are determined. For example, a plurality of sensed values of a first control variable are received and an average value of the first control variable is determined; a plurality of sensed values of a second control variable are received and an average value of the second control variable is determined; and so on with the remaining control variables an average may be determined based on a plurality of sensed values. The average values of the sensed control variable values are stored for later processing.

At block 240 a calculated burner gain value is determined based on the first set of sensed control variable values, the second set of sensed control variable values, the first set of manipulated variable values, and the second set of manipulated variable values. In an embodiment, the calculated burner gain value is determined based on determining an average of the first set of sensed control variable values and based on determining an average of the second set of sensed control variable values. The sensed control variable values may be read from memory where the values were stored, for example during block 208 and block 226. In an embodiment, the manipulated variable value is returned to the first manipulated variable value, a timed wait is conducted to allow the system 100 to return to a steady state, the set of control variable sensed values is received, a gain is calculated, and the overall gain is determined as the average of the two gains, along the lines described above with reference to Eq. 3.

At block 242, the multivariable control algorithm 114 is updated based on the calculated burner gain value. In an embodiment, the multivariable control algorithm 114 is updated based on filtering the calculated burner gain value. For example, in an embodiment, the multivariable control algorithm 114 is updated based on first order filtering and/or low pass filtering the calculated burner gain value. This may involve writing one or more updated gain values to the gain matrix 130. When a calculated gain value is below a threshold value, a zero value may be defined for the subject gain in the gain matrix 130 to avoid inadvertently creating a functional relationship between a manipulated variable and a control variable which is not in fact valid or real or which it is otherwise undesirable that the multivariable control algorithm 114 incorporate. This may be referred to as nulling the subject gain. Additionally, in some cases a maximum gain value and a minimum gain value may be defined by the multivariable control algorithm 114 for specific pairs of manipulated value-control variables. When the calculated gain is greater than the maximum gain value, the gain is forced to the maximum gain value, and when the calculated gain is less than the minimum gain value, the gain is forced to the minimum gain value.

At block 244, a fourth manipulated variable value is determined by the multivariable control algorithm 114, now operating not in an adaptation cycle but in normal control mode of operation. At block 246, the control system 112 sends the fourth manipulated variable value to the boiler 102.

Note that since a plurality of control variables may change value in response to the stepping of a single manipulated variable, the process of method 200 may determine a plurality of gains during one iteration, a separate gain for each of the control variables dependent on the subject manipulated variable. Also note that the method 200 may be repeated for each of the manipulated variables of the system 100 during a complete adaptation cycle. As an example, suppose there are 3 manipulated variables called X, Y, and Z each interacting with three control variables A, B, and C. This implies 9 gains $G_{ax}$, $G_{bx}$, $G_{cx}$; $G_{ay}$, $G_{by}$, $G_{cy}$; $G_{az}$, $G_{bz}$, $G_{cz}$. Suppose the sensed control variable values $A_1$, $B_1$, and $C_1$ correspond to the manipulated variable value $X_1$ at $time_1$; the sensed control variable values $A_2$, $B_2$, and $C_2$ correspond to the manipulated variable value $X_2$ at $time_2$; and the sensed control variable values $A_3$, $B_3$, and $C_3$ correspond to the manipulated variable value $X_3$ at $time_3$. Gains associated with the manipulated variable X may be calculated as $$G_{ax1}=(A_2-A_1)/(X_2-X_1) \quad \text{Eq. 7}$$

$$G_{bx1}=(B_2-B_1)/(X_2-X_1) \quad \text{Eq. 8}$$

$$G_{cx1}=(C_2-C_1)/(X_2-X_1) \quad \text{Eq. 9}$$

$$G_{ax2}=(A_3-A_2)/(X_3-X_2) \quad \text{Eq. 10}$$

$$G_{bx2}=(B_3-B_2)/(X_3-X_2) \quad \text{Eq. 11}$$

$$G_{cx2}=(C_3-C_2)/(X_3-X_2) \quad \text{Eq. 12}$$

As discussed further above with reference to Eq. 1A or Eq. 1B and Eq. 2A or Eq. 2B, in an embodiment, the gains may be calculated instead as reciprocals of the expressions given in equations Eq. 7 through Eq. 12. These gains then may be averaged as $$G_{ax}=(G_{ax1}+G_{ax2})/2 \quad \text{Eq. 13}$$

$$G_{bx}=(G_{bx1}+G_{bx2})/2 \quad \text{Eq. 14}$$

$$G_{cx}=(G_{cx1}+G_{cx2})/2 \quad \text{Eq. 15}$$

Also, if G<Min, then G=Min; and if G>Max, then G=Max, as discussed further above. The values of the control variables A, B, and C may be averaged values calculated over a plurality of sensor values sampled while the subject manipulated variable is held constant. Gains for the control variables A, B, and C associated with the manipulated variables Y and Z may be calculated in a similar fashion.

In an embodiment, an adaptation cycle of the multipliers of the neural network algorithm 116 may be performed concurrently with the adaptation cycle of the gains of the multivariable control algorithm 114. In an embodiment, predicted gains are calculated using the predicted values of the control variable values produced by the neural network for the corresponding held values of the manipulated variables, and a ratio of actual gains determined as above to the predicted gains is used to calculate the multipliers. For example, suppose the neural network algorithm 116 produced predicted control variable values of $NNA_1$, $NNB_1$, and $NNC_1$ for control variables A, B, and C corresponding to $time_1$; control variable values of $NNA_2$, $NNB_2$, and $NNC_2$ for control variables A, B, and C corresponding to $time_2$; and control variable values of $NNA_3$, $NNB_3$, and $NNC_3$ for control variables A, B, and C corresponding to $time_3$. Then neural network predicted gains associated with the manipulated variable X may be determined as $$NNG_{AX}=\{[(NNA_2-NNA_1)/(X_2-X_1)]+[(NNA_3-NNA_2)/(X_3-X_2)]\}/2 \quad \text{Eq. 16}$$

$$NNG_{BX}=\{[(NNB_2-NNB_1)/(X_2-X_1)]+[(NNB_3-NNB_2)/(X_3-X_2)]\}/2 \quad \text{Eq. 17}$$

$$NNG_{CX}=\{[(NNC_2-NNC_1)/(X_2-X_1)]+[NNC_3-NNC_2)/(X_3-X_2)]\}/2 \quad \text{Eq. 18}$$

and multipliers may be calculated as $$NN_{AX}=G_{AX}/NNG_{AX} \quad \text{Eq. 19}$$

$$NN_{BX}=G_{BX}/NNG_{BX} \quad \text{Eq. 20}$$

$$NN_{CX}=G_{CX}/NNG_{CX} \quad \text{Eq. 21}$$

Multipliers associated with the control variables A, B, and C may be determined in a similar fashion for manipulated variables Y and Z. In an embodiment, however, the multipliers may be obtained in a different fashion, for example employing reciprocals of some terms.

It is understood, however, that the equations Eq. 7 through Eq. 21 are exemplary, and one skilled in the art, in combination with the present disclosure, will appreciate there are other ways to apply and implement the teachings of the present disclosure. For example, there may be simplifications and approximations that are employed in implementing the present teachings in the system 100 that one skilled in the art will readily understand.

In an embodiment, at block 204 an initial value may be determined for each of a plurality of different manipulated variables, for example a first manipulated variable, a second manipulated variable, and a third manipulated variable. The first, second, and third manipulated variables may be related in some way, for example by each being associated with the same one of the burners 104 or by some other relationship. The initial values of the different manipulated variables are sent by the control system 112 to the appropriate actuators in the boiler 102, and these values are held or continuously output by the control system 112. Then the processing of blocks 220 through 226 is performed on each of the different manipulated variables in turn, where after one of the manipulated variables in stepped and the sensed values received at block 226 that manipulated variable value is set back to the initial value and held. After the plurality of different manipulated variables have each been stepped, the processing of blocks 240 and 242 may be performed for each of these manipulated variables.

Figure 5:
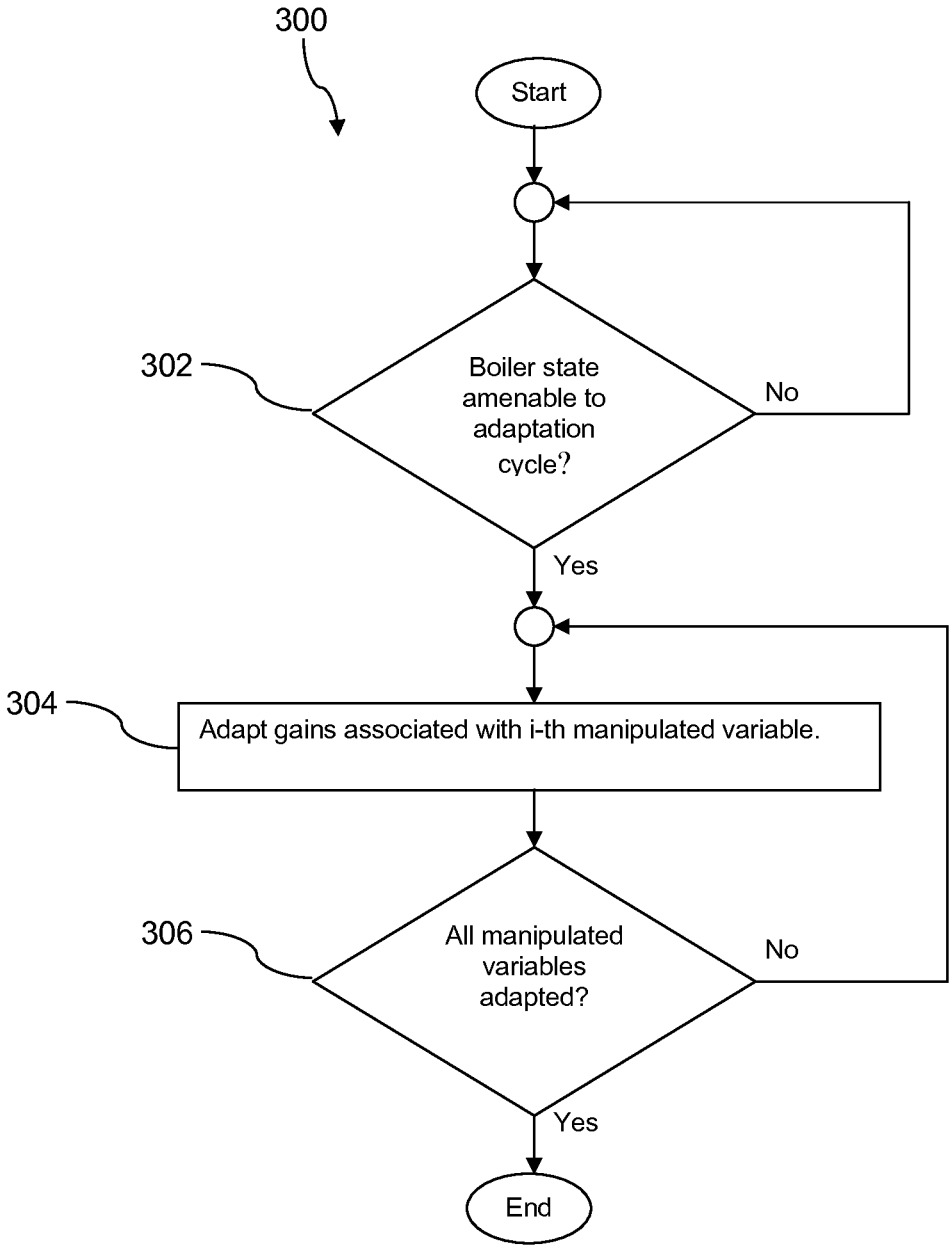
FIG. 5 is a flowchart of another method according to an embodiment of the disclosure.

Turning now to FIG. 5, a method 300 is described. At block 302 if the state of the boiler 102 is amenable to conducting an adaptation cycle, the processing moves to block 304. At block 304 gains associated with the multivariable control algorithm 114 are adapted based on perturbing and/or stepping one of the manipulated variables as described above. At block 306, if all of the manipulated variables have not yet been perturbed and/or stepped, the process returns to block 304 where another one of the manipulated variables is stepped. When all the manipulated variables that are desired to be perturbed during the adaptation cycle have been perturbed, the process ends. By iterating through the loop of blocks 304 and 306 all the manipulated variables may be perturbed and the control system 112 adapted. The processing of the method 300 may further comprise adapting the multipliers of the neural network control algorithm 140 as described above. Note that the processing in block 304 may comprise stepping and adapting a plurality of manipulated variables together, for example along the lines described above at the end of the discussion of the method 200.

It is understood that in an embodiment the processing of blocks 302, 304, and 306 may be repeated several times during an adaptation cycle. For example, when the gain calculations are smoothed with a filter, for example a first order low-pass filter, it may be desirable to repeat the processing of blocks 302, 304, and 306 to promote the gains output by the filter to converge with the raw calculated gains. In an embodiment, the step values sent to the manipulated variables by the control system 112 and/or by the adaptation algorithm may be increased in value relative to the initial value in a first pass through the blocks 302, 304, 306 and decreased in value relative to the initial value in a second pass through the blocks 302, 304, 306.

Figure 6:
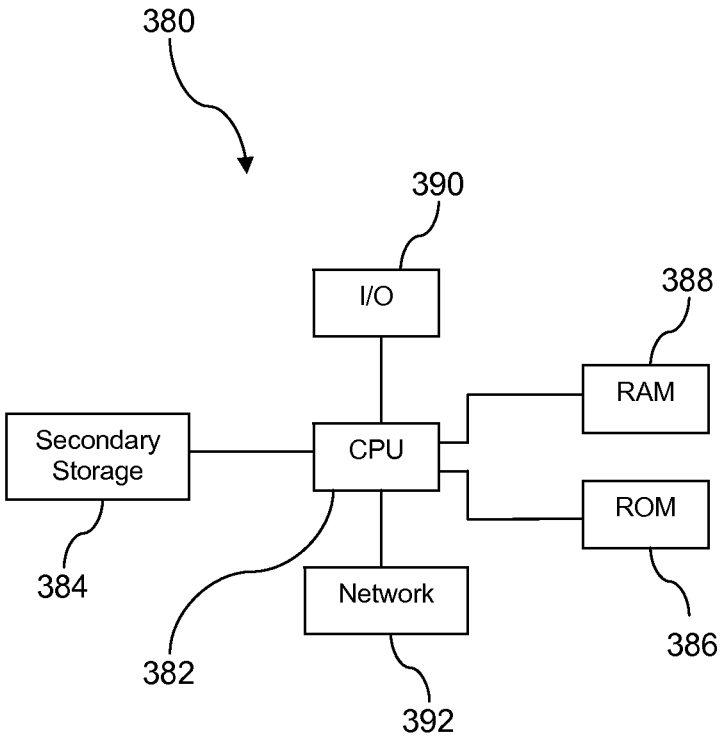
FIG. 6 is an illustration of a computer system according to an embodiment of the disclosure.

The control system 112 described above may be implemented on any computer with sufficient processing power, memory resources, and network throughput capability to handle the necessary workload placed upon it. FIG. 6 illustrates a typical, computer system suitable for implementing one or more embodiments disclosed herein. The computer system 380 includes a processor 382 (which may be referred to as a central processor unit or CPU) that is in communication with memory devices including secondary storage 384, read only memory (ROM) 386, random access memory (RAM) 388, input/output (I/O) devices 390, and network connectivity devices 392. The processor may be implemented as one or more CPU chips.

It is understood that by programming and/or loading executable instructions onto the computer system 380, at least one of the CPU 382, the RAM 388, and the ROM 386 are changed, transforming the computer system 380 in part into a particular machine or apparatus having the novel functionality taught by the present disclosure. It is fundamental to the electrical engineering and software engineering arts that functionality that can be implemented by loading executable software into a computer can be converted to a hardware implementation by well known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

The secondary storage 384 is typically comprised of one or more disk drives or tape drives and is used for non-volatile storage of data and as an over-flow data storage device if RAM 388 is not large enough to hold all working data. Secondary storage 384 may be used to store programs which are loaded into RAM 388 when such programs are selected for execution. The ROM 386 is used to store instructions and perhaps data which are read during program execution. ROM 386 is a non-volatile memory device which typically has a small memory capacity relative to the larger memory capacity of secondary storage 384. The RAM 388 is used to store volatile data and perhaps to store instructions. Access to both ROM 386 and RAM 388 is typically faster than to secondary storage 384. The secondary storage 384, the RAM 388, and/or the ROM 386 may be referred to in some contexts as computer readable storage media and/or non-transitory computer readable media.

I/O devices 390 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 392 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards such as code division multiple access (CDMA), global system for mobile communications (GSM), long-term evolution (LTE), worldwide interoperability for microwave access (WiMAX), and/or other air interface protocol radio transceiver cards, and other well-known network devices. These network connectivity devices 392 may enable the processor 382 to communicate with the Internet or one or more intranets. With such a network connection, it is contemplated that the processor 382 might receive information from the network, or might output information to the network in the course of performing the above-described method steps. Such information, which is often represented as a sequence of instructions to be executed using processor 382, may be received from and outputted to the network, for example, in the form of a computer data signal embodied in a carrier wave.

Such information, which may include data or instructions to be executed using processor 382 for example, may be received from and outputted to the network, for example, in the form of a computer data baseband signal or signal embodied in a carrier wave. The baseband signal or signal embodied in the carrier wave generated by the network connectivity devices 392 may propagate in or on the surface of electrical conductors, in coaxial cables, in waveguides, in an optical conduit, for example an optical fiber, or in the air or free space. The information contained in the baseband signal or signal embedded in the carrier wave may be ordered according to different sequences, as may be desirable for either processing or generating the information or transmitting or receiving the information. The baseband signal or signal embedded in the carrier wave, or other types of signals currently used or hereafter developed, may be generated according to several methods well known to one skilled in the art. The baseband signal and/or signal embedded in the carrier wave may be referred to in some contexts as a transitory signal.

The processor 382 executes instructions, codes, computer programs, scripts which it accesses from hard disk, floppy disk, optical disk (these various disk based systems may all be considered secondary storage 384), ROM 386, RAM 388, or the network connectivity devices 392. While only one processor 382 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 384, for example, hard drives, floppy disks, optical disks, and/or other device, the ROM 386, and/or the RAM 388 may be referred to in some contexts as non-transitory instructions and/or non-transitory information.

In an embodiment, the computer system 380 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computer system 380 to provide the functionality of a number of servers that is not directly bound to the number of computers in the computer system 380. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may comprise cloud computing resources owned and operated by the enterprise as well as cloud computing resources hired and/or leased from a third party provider.

In an embodiment, some or all of the functionality disclosed above may be provided as a computer program product. The computer program product may comprise one or more computer readable storage medium having computer usable program code embodied therein to implement the functionality disclosed above. The computer program product may comprise data structures, executable instructions, and other computer usable program code. The computer program product may be embodied in removable computer storage media and/or non-removable computer storage media. The removable computer readable storage medium may comprise, without limitation, a paper tape, a magnetic tape, magnetic disk, an optical disk, a solid state memory chip, for example analog magnetic tape, compact disk read only memory (CD-ROM) disks, floppy disks, jump drives, digital cards, multimedia cards, and others. The computer program product may be suitable for loading, by the computer system 380, at least portions of the contents of the computer program product to the secondary storage 384, to the ROM 386, to the RAM 388, and/or to other non-volatile memory and volatile memory of the computer system 380. The processor 382 may process the executable instructions and/or data structures in part by directly accessing the computer program product, for example by reading from a CD-ROM disk inserted into a disk drive peripheral of the computer system 380. Alternatively, the processor 382 may process the executable instructions and/or data structures by remotely accessing the computer program product, for example by downloading the executable instructions and/or data structures from a remote server through the network connectivity devices 392. The computer program product may comprise instructions that promote the loading and/or copying of data, data structures, files, and/or executable instructions to the secondary storage 384, to the ROM 386, to the RAM 388, and/or to other non-volatile memory and volatile memory of the computer system 380.

In some contexts, a baseband signal and/or a signal embodied in a carrier wave may be referred to as a transitory signal. In some contexts, the secondary storage 384, the ROM 386, and the RAM 388 may be referred to as a non-transitory computer readable medium or a computer readable storage media. A dynamic RAM embodiment of the RAM 388, likewise, may be referred to as a non-transitory computer readable medium in that while the dynamic RAM receives electrical power and is operated in accordance with its design, for example during a period of time during which the computer 380 is turned on and operational, the dynamic RAM stores information that is written to it. Similarly, the processor 382 may comprise an internal RAM, an internal ROM, a cache memory, and/or other internal non-transitory storage blocks, sections, or components that may be referred to in some contexts as non-transitory computer readable media or computer readable storage media.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A multivariable control system for controlling a plurality of burners of a boiler in a steam cycle system, comprising:

a plurality of actuators affecting the operation of the burners;

a plurality of sensors sensing control variable values in the boiler;

a control system coupled to the actuators and the sensors and comprising a memory and a processor; and an application stored in the memory that, when executed by the processor executes a multivariable control algorithm to determine manipulated variable values to send to the actuators to control in part the burners while in-operation, the determination of the manipulated variable values based on control variable data received from the sensors and based on a plurality of gain values and executes an adaptation algorithm while the burners are in-operation to change a manipulated variable value sent to one of the burners from a first value to a second value, to maintain the manipulated variable value at the second value for a pre-determined period of time, to determine a change of a control variable value received from the sensors, to return the manipulated variable value to the first value, to determine a gain value based on a difference between the first value of the manipulated variable and the second value of the manipulated variable and based on the change in control variable data received from the sensors, and to provide the determined gain value to the multivariable control algorithm.

2. The multivariable control system of claim 1, wherein the adaptation algorithm determines the gain value further based on low-pass filtering the difference between the first value of the manipulated variable and the second value of the manipulated variable and the change in control variable data received from the sensors.

3. The multivariable control system of claim 2, wherein the low-pass filtering is performed using a first order filter.

4. The multivariable control system of claim 1, wherein the manipulated variable value is one of a register manipulated variable value, a damper manipulated variable value, or a burner tilt manipulated variable value.

5. The multivariable control system of claim 1, wherein the pre-determined period of time is at least 10 minutes.

6. The multivariable control system of claim 1, wherein the sensors measure one or more of a concentration of a nitrogen oxides control variable, a concentration of oxygen control variable, and a concentration of carbon monoxide control variable.

7. A method of controlling burners of a boiler in a steam cycle system, comprising:

determining that the state of the boiler is amenable to conducting an adaptation cycle;

sending a first manipulated variable value determined by a multivariable control algorithm to a burner actuator;

receiving a first set of control variable sensed values from the boiler after waiting a predetermined time duration after sending the first manipulated variable value to the burner actuator;

determining a second manipulated variable value by the multivariable control algorithm based on the first set of control variable sensed values;

sending a third manipulated variable value that is determined by an adaptation algorithm to the burner actuator after receiving the first set of control variable sensed values, wherein the third manipulated variable value is different from the second manipulated variable value and is different from the first manipulated variable value;

receiving a second set of control variable sensed values from the boiler after waiting the predetermined time duration after sending the third manipulated variable value to the burner actuator;

determining a calculated burner gain value based at least in part on the first set of control variable sensed values, the second set of control variable sensed values, the first manipulated variable value, and the third manipulated variable value;

updating the multivariable control algorithm with the calculated burner gain value;

determining a fourth manipulated variable value by the multivariable control algorithm based on the calculated burner gain value; and sending the fourth manipulated variable value to the burner actuator.

8. The method of claim 7, further comprising comparing the calculated burner gain value to a burner gain value stored in the multivariable control algorithm before updating the multivariable control algorithm with the calculated burner gain value, wherein the multivariable control algorithm is updated with the calculated burner gain when the comparison is less than a pre-defined change value.

9. The method of claim 7, further comprising continuing to send the third manipulated variable value to the burner actuator for at least the predetermined time duration.

10. The method of claim 7, further comprising determining an average control variable sensed value based on the second set of control variable sensed values, wherein the calculated burner gain value is determined at least in part based on the average control variable sensed value.

11. The method of claim 7, wherein the third manipulated variable value differs from the first manipulated variable value by at least 3% of the first manipulated variable.

12. The method of claim 7, wherein the calculated burner gain is determined at least in part using a first order filter.

13. The method of claim 7, further comprising adjusting parameters of a neural network control algorithm based on the calculated burner gain value, wherein the neural network control algorithm controls a burner actuator not controlled by the multivariable control algorithm.

14. A computer program product for adapting a gain of a multivariable control algorithm to control a burner in a boiler in an industrial process, the computer program product comprising:

a non-transitory computer readable storage medium having a computer usable program code embodied therein, the computer usable program code to execute an adaptation algorithm while the burner in the boiler is in-operation to change a manipulated variable value sent to the burner from a first value to a second value, to maintain the manipulated variable value at the second value for a pre-determined period of time, to determine a change in control variable data received from a plurality of boiler sensors, to return the manipulated variable value to the first value, to determine a gain value based on a difference between the first value and the second value and based on the change in control variable data received from the boiler sensors, and to provide the determined gain value to a multivariable control algorithm that controls the burner.

15. The computer program product of claim 14, wherein the burner in the boiler remains under closed loop control exercised by the multivariable control algorithm while the adaptation algorithm executes and provides the determined gain value to the multivariable control algorithm.

16. The computer program product of claim 14, wherein the adaptation algorithm performs an on-line stepping adaptation of the gain value.

17. The computer program product of claim 14, wherein the second value of the manipulated variable value is a perturbation of the steady state operation of the boiler.

18. The computer program product of claim 14, wherein the adaptation algorithm adjusts the gain value to automatically adapt the burner to compensate for roping of pulverized coal fuel feed.

19. The computer program product of claim 14, wherein the adaptation algorithm determines gain values for a plurality of burner actuators.

20. The computer program product of claim 19, wherein the adaptation algorithm determines a matrix used by the multivariable control algorithm, wherein the matrix comprises a plurality of vectors of gain values, each vector of gain values associated with a different operating load of the industrial process.

* * * * *